US006998210B2

(12) United States Patent
Yoshimura et al.

(10) Patent No.: US 6,998,210 B2
(45) Date of Patent: Feb. 14, 2006

(54) ELECTROPHOTOGRAPHIC PHOTOSENSITIVE MEMBER, ELECTROPHOTOGRAPHIC APPARATUS, AND PROCESS CARTRIDGE

(75) Inventors: Kimihiro Yoshimura, Kanagawa (JP); Yosuke Morikawa, Kanagawa (JP); Tatsuya Ikezue, Kanagawa (JP); Kouichi Nakata, Ibaraki (JP); Daisuke Tanaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/714,948

(22) Filed: Nov. 18, 2003

(65) Prior Publication Data

US 2004/0101774 A1 May 27, 2004

(30) Foreign Application Priority Data

Nov. 18, 2002 (JP) ..... 2002-333709

(51) Int. Cl.
*G03G 5/147* (2006.01)

(52) U.S. Cl. ..... 430/66; 430/59.6; 430/96; 430/132; 399/116; 399/259

(58) Field of Classification Search ..... 430/58.05, 430/59.6, 66, 96, 132; 399/159, 116
See application file for complete search history.

(56) References Cited

U.S. PATENT DOCUMENTS

| | | | | |
|---|---|---|---|---|
| 5,430,526 | A * | 7/1995 | Ohkubo et al. | 399/159 |
| 5,476,968 | A * | 12/1995 | Imai et al. | 564/309 |
| 5,693,443 | A * | 12/1997 | Nakamura et al. | 430/66 |
| 5,837,412 | A | 11/1998 | Suzuki et al. | |
| 6,492,081 | B1 | 12/2002 | Morikawa et al. | 430/66 |
| 2002/0119382 | A1 * | 8/2002 | Nakata et al. | 430/66 |
| 2003/0175603 | A1 | 9/2003 | Nakata et al. | 430/58.1 |
| 2003/0175604 | A1 | 9/2003 | Morikawa et al. | 430/58.8 |
| 2003/0194625 | A1 | 10/2003 | Tanaka et al. | 430/58.8 |

FOREIGN PATENT DOCUMENTS

| | | | |
|---|---|---|---|
| JP | 61-041152 | * | 2/1986 |
| JP | 08-095267 | * | 4/1996 |
| JP | 10-228126 | | 8/1998 |
| JP | 2002-82466 | | 3/2002 |

OTHER PUBLICATIONS

Japanese Patent Office English-language abstract describing JP 61-041152, copyright 1998.*
STN CAPLUS abstract AN 1986:505756, describing JP61-041152, entered in STN on Sep. 19, 1986.*
English-language translation of JP 61-041152 (pub. Feb. 1986).*
Machine-assisted translation of JP 08-095267 (pub. Apr. 1996).*

* cited by examiner

*Primary Examiner*—Janis L. Dote
(74) *Attorney, Agent, or Firm*—Fitzpatrick, Cella, Harper & Scinto

(57) ABSTRACT

The present invention relates to an electrophotographic photosensitive member comprising a surface layer excellent in adhesiveness and abrasion resistance, having a hardness and a toughness, and not degrading the charge transport property. One aspect of the present invention provides an electrophotographic photosensitive member comprising a photosensitive layer on a conductive support, wherein a surface layer of the photosensitive member contains a crosslinked epoxy-modified resol type phenolic resin, and at least one of a charge transport material and a conductive fine particle.

6 Claims, 2 Drawing Sheets

ELECTROPHOTOGRAPHIC PHOTOSENSITIVE MEMBER, ELECTROPHOTOGRAPHIC APPARATUS, AND PROCESS CARTRIDGE

BACKGROUND OF THE INVENTION

1. Field of the Invention

The present invention relates to an electrophotographic photosensitive member, and a process cartridge and an electrophotographic apparatus comprising the electrophotographic photosensitive member.

2. Related Background Art

The electrophotographic process comprises, for example, forming a latent image by charging and exposing a photosensitive member having at least a photosensitive layer on a conductive support; forming a developed image with the aid of a toner; transferring the developed image to a transfer medium that is mainly paper; and removing/recovering (cleaning) the transfer remaining toner. The electrophotographic photosensitive member used in this case is required to have a necessary sensitivity, electric characteristics and optical characteristics in conformity with the applied electrophotographic process. Electrical and mechanical external forces, including charging, toner development, transfer to paper and cleaning of remaining toner, are exerted directly to the surface of the photosensitive member that is used repeatedly, and hence the surface concerned is required to have the resistance to these external forces. More specifically, resistance is required against the scratch and abrasion due to sliding friction, and particularly, resistance is required against the chemical deterioration due to ozone and NOx generated at high humidities when a charging scheme involving discharge is adopted. Furthermore, at the time of repeating the cleaning of the remaining toner, there occurs a problem that the toner adheres to the photosensitive member surface and cleaning with a blade causes scraping of the photosensitive member surface by the blade, and hence the photosensitive member surface is required to have such characteristics as slidability, releasability, and antistaining property.

In order to meet the demands described above, as the material for the surface layer of the photosensitive member, it is widely proposed to use a resin excellent in releasability and slidablity such as represented by fluorine-based resins, and a highly hard resin material such as represented by silicone resin, urethane resin, and unsaturated ester materials.

However, a material fulfilling the above described various characteristics has not so far been found. More specifically, a fluorine-based resin alone is low in hardness so it can hardly suppress the scratch generation, and it is scarcely soluble in common solvents so formation of its film is not easy.

On the other hand, there is reported an example in which for the photosensitive member, used is highly hard materials such as a cured silicone resin taking advantage of the high reactivity of alkoxysilane; however, these resins are not satisfactory in such aspects as slidability, electric characteristics at high humidities, and releasability. Furthermore, these cured materials are highly reactive to the hydroxy group so that there are some constraints on the solvent for use in photosensitive layer coating, and additionally the curing reaction slowly proceeds in these materials under the effect of the contained moisture so that the stability of the coating solution is poor, which is problematic from the viewpoint of the productivity of the photosensitive member.

Additionally, a material for cured film formation through cleavage of unsaturated bonds such as prepolymers of diallylphthalate resin is generally of the radical polymerization type, and the coating solution using this material is comparatively stable to moisture; however, this material can merely yield a cured material unstable in electric characteristics including insulation resistance owing to the poor curing on the film surface caused by the polymerization inhibition effect due to the oxygen in the air, and owing to the carbon-carbon bond cleavage reaction and the like caused by light irradiation when a photoinitiator is used. Accordingly, there have been problems that the transfer efficiency is degraded due to the elevated surface free energy and the image blurring is caused by moisture absorption.

On the other hand, the material for use in the surface layer of the photosensitive member is required to have the electric characteristic that secures smooth charge transfer even in the interior of the uppermost surface layer, in addition to the above described hardness and slidability. In this connection, if the surface layer has no function for conducting charge transfer, the charge accumulation occurs in the interior of the photosensitive layer in such a way that the repetition of the electrophotography process of charging-exposing results in the elevated residual potential, leading to the image quality degradation.

For the purpose of solving this problem, a method has been proposed in which a charge transport material is contained in the surface layer. For example, when curing is made by adding a charge transport material to alkoxysilanes, the charge transport material and the siloxane component are frequently poor in compatibility with each other, and when a charge transport material is added to a resin having a high polarity unit such as urethane resin, the charge mobility due to the charge transport material is lowered, actually leading to unsatisfactory electrophotographic characteristics.

Furthermore, among the thermosetting resins, various materials are not compatible with mere application of heat treatment, but need the addition of curing catalysts such as curing accelerators and polymerization initiators. However, when such a curing catalyst remains in the cured film, possibly there occur such an adverse effect that the charge transfer is inhibited by even a small amount thereof, or the electric resistance of the cured film is degraded. On the other hand, a coating material added with a curing catalyst tends to undergo slowly processing reaction even at ambient temperature, resulting in degradation of the stability of the coating material, which leads to an adverse effect that the mass production of coating materials and the storage thereof become a hard task.

Additionally, main schemes for the electrophotographic photosensitive member involve electric discharge, among which a charging scheme, involving discharge in a thin gap between the electrophotographic photosensitive member and the charging member applied both with a DC voltage and with an AC voltage, is the one excellent in charging stability among the contact charging schemes, but involves a phenomenon that the surface composition of the electrophotographic photosensitive member is destroyed in an oxidatively deteriorated manner, leading to an elevation of the surface free energy causing the transfer efficiency degradation. Furthermore, when a thermosetting resin is used, the abrasion amount of the photosensitive layer is small, and hence the destroyed material in an oxidatively deteriorated manner possibly causes a problem of image blurring due to moisture absorption.

Additionally, in general, when the surface layer comprising a cured resin is provided on the photosensitive layer comprising a thermosetting resin, if, as is the case for the surface layer comprising a fluorine-based resin as the cured resin, the cured resin is totally different from the photosetting resin in chemical composition, the adhesiveness of the surface layer to the photosensitive layer is poor so that a part of the photosensitive layer may sometimes be peeled when used over a long period of time in the electrophotographic process, resulting in an adverse effect of generating deficient images.

Additionally, in general, the more the crosslinking density of cured resins is increased, the harder the cured resins are surely, but concurrently the more brittle the cured resin is. Furthermore, such curing resins lead to extreme increase in the surface roughness of the electrophotographic photosensitive member in the long term course of the use thereof, sometimes causing adverse effects on the images, and accordingly the fact is such that no satisfactory materials have been obtained in adaptation of curing resins to the surface layer.

Additionally, Japanese Patent Application Laid-Open No. H10-228126 discloses an example in which the surface layers of the photosensitive members are made to contain a charge transport material containing phenolic hydroxy groups and hydroxyalkyl groups; however, even these photosensitive members cannot meet the recent demands for high durability, high productivity and high image quality, and the fact is such that all the items including the mechanical strength, residual potential, productivity and the like are not yet sufficiently satisfied.

Additionally, Japanese Patent Application Laid-Open No. 2002-82466 discloses that an electrophotographic photosensitive member, which comprises a protective layer containing a resol type phenolic resin and a metal particle or a metal oxide particle, exhibits little elevation of the residual potential in the low humidity environment, provides such high quality images as free from blurring and smearing in the high temperature environment, displays excellent releasability, and has excellent durability against the generation of abrasion and scratches.

SUMMARY OF THE INVENTION

An object of the present invention is to provide an electrophotographic photosensitive member which has a surface layer excellent in abrasion resistance, having such hardness as preventing generation of scratches and the like, and still is free from degradation of the charge transport property of the photosensitive member itself without the addition of a curing catalyst. Furthermore, another object of the present invention is to provide an electrophotographic photosensitive member which has a surface layer able to be applied with high productivity. Additionally, another object of the present invention is to provide a high quality electrophotographic photosensitive member which is satisfactory in adhesiveness with the lower layer and displays excellent resistance to the deterioration due to discharge. Additionally, another object of the present invention is to provide a process cartridge and an electrophotographic apparatus which are constructed on the basis of the electrophotographic photosensitive member having the above described characteristics.

According to one aspect of the present invention, there is provided that an electrophotographic photosensitive member comprising a photosensitive layer on a conductive support, wherein the surface layer of the photosensitive member comprises a crosslinked epoxy-modified resol type phenolic resin obtained by adding an epoxy group to a phenolic hydroxy group of a resol type phenolic resin, and at least one of a charge transport material and a conductive fine particle.

According to another aspect of the present invention, there is provided a process cartridge comprising the above described electrophotographic photosensitive member, and at least one means selected from the group consisting of a charging means, a developing means and a cleaning means which are integrally supported, and being detachably mountable to the main body of an electrophotographic apparatus.

According to further aspect of the present invention, there is provided an electrophotographic apparatus comprising the above described electrophotographic photosensitive member, a charging means, an exposing means, a developing means, and a transfer means.

DETAILED DESCRIPTION OF THE PREFERRED EMBODIMENTS

Figure 1A:
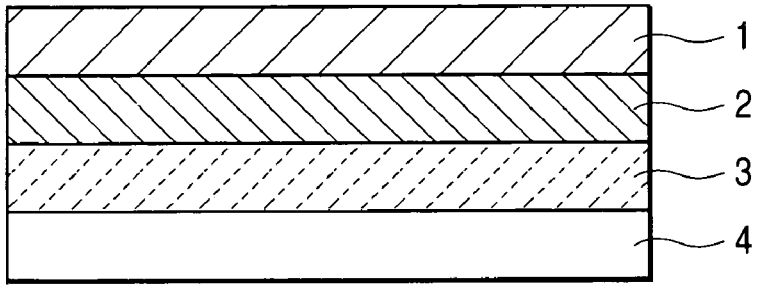
FIGS. 1A, 1B, 1C and 1D are schematic sectional views illustrating electrophotographic photosensitive members of the present invention.

Detailed description will be made below on the embodiments of the present invention.

As a result of diligent investigation, the present inventors came to discover that the above described problems can be solved by an electrophotographic photosensitive member comprising a surface layer containing a crosslinked material derived from an epoxy modified phenolic resin having a specific structure and at least either one of a charge transport material and a conductive fine particle.

The epoxy modified phenolic resin involved in the present invention is the one obtained by adding epoxy groups to the phenolic hydroxy groups in resol type phenolic resin. The resol type phenolic resin as referred to here is a compound obtained by the addition and condensation reaction between a compound having phenolic hydroxy groups and aldehydes in the presence of an alkaline catalyst; the hydroxymethyl group generated when formaldehyde is added to the phenol ring becomes a reactive crosslinking group. Examples of the compounds having the phenolic hydroxy group include phenol, cresol, xylenol, para-alkylphenol, para-phenylphenol, resorcin, bisphenol and the like. Examples of the aldehydes include formaldehyde, paraformaldehyde, furfural, acetaldehyde and the like.

Additionally, the epoxy modification of the phenolic hydroxy groups of the resol type phenolic resin can be performed by a procedure in which a compound having epoxy rings is mixed in the reaction system when a compound having phenolic hydroxy groups is allowed to react with aldehydes under an alkaline condition, making the phenolic hydroxy groups and the epoxy rings undergo the addition and condensation reaction therebetween. Heat treatment at the temperatures of the order of 130° C. to 170° C. applied to such a resin, in which the phenolic hydroxy groups of the resol type phenolic resin are modified by use of the epoxy groups, causes the ether bond formation or further the condensation reaction to proceed owing to the mutual condensation reaction between the hydroxymethyl groups, resulting in the methylene bond formation, or causes the condensation reaction to occur between the hydroxymethyl groups and the hydrogens in para and ortho positions in relation to the phenolic hydroxy groups, resulting in the methylene bond formation; the occurrence of these condensation reactions between various molecules makes it possible to obtain a three-dimensional cured film with high crosslinking density. These condensation reactions are the ones that are not inhibited in nature by the moisture and oxygen in the air, and are allowed to proceed even in a system added with a charge transport material. The crosslinking reaction based on the heat treatment of the epoxy modified phenolic resin has a feature that the reaction needs no addition of such a curing catalyst as generally used in thermosetting. Accordingly, when the compound involved in the present invention is used in the surface layer of an electrophotographic photosensitive member, there occur no problems including the residual potential elevation and the electric resistance decrease in the uppermost surface layer caused by the residual curing catalyst.

Additionally, the epoxy modified resol type phenolic resin of the present invention is characterized in that the resin is obtained by adding the epoxy groups to the phenolic hydroxy groups of a resol type phenolic resin, but is not merely a blend composed of a phenolic resin and an epoxy resin. The relation between the phenolic resin and the epoxy resin is the one between a major component and a curing agent, and hence only blending leads to slow progress of the curing reaction, reducing the pot life. On the contrary, a blending based on a slowly reactive combination of an epoxy resin and a phenol resin leads to a slow curing by heating so that obtaining sufficient hardness requires heating to such an extent that the photosensitive member characteristics are remarkably damaged; however, according to the epoxy modified phenolic resin involved in the present invention, the reaction between the epoxy groups and the phenolic hydroxy groups has already been completed, resulting in liberation from such heat treatment as causing pot life reduction and thermal deterioration.

Additionally, the epoxy modified phenolic resin involved in the present invention has been found excellent in the coating solution stability because the resin can undergo crosslinking by heating and hence needs no addition of a curing catalyst, and the hydroxymethyl group itself has a sufficient stability against the moisture in a contrast to isocyanate and silicone resins.

Additionally, as for the epoxy modified phenolic resin involved in the present invention, when the modification of the phenolic hydroxy group is performed, for example, by use of the epoxy groups represented by the following formulas (1) and (2), the resin comes to have the ether bonds respectively represented by the following formulas (3) and (4). Furthermore, in addition to the ether bonds, the presence of such bond groups high in flexibility as the alkylene bonds, cycloalkylene bonds and ester bonds found in the skeleton of the epoxy compound used in the modification provides the epoxy modified phenolic resin involved in the present invention or the crosslinked material derived therefrom with the toughness imparted with the ductility and flexibility found in the film in addition to excellent film strength of ordinary curable phenolic resins. Furthermore, it is also possible to intend the improvement of the adhesiveness to adherend.

(1)

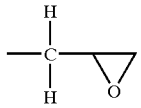

(2)

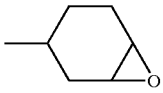

(3)

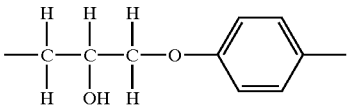

(4)

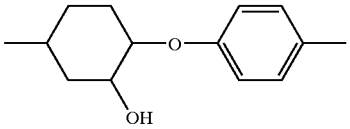

In the present invention, examples of the compounds containing the epoxy groups used in the modification of the phenolic hydroxy groups include the epoxy compounds represented by the following structural formulas EP1 to EP26. In particular, the use of a multifunctional epoxy compound makes it possible to further increase the hardness of the surface layer after the film formation and curing.

EP1

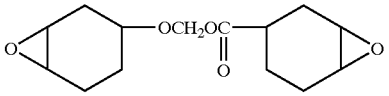

EP2

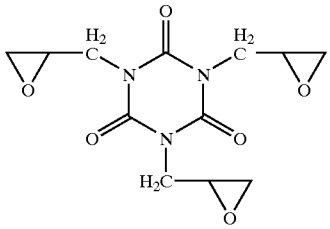

-continued
EP3
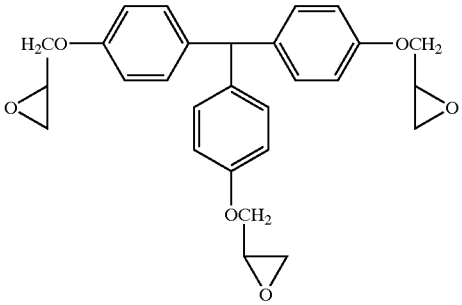
EP4
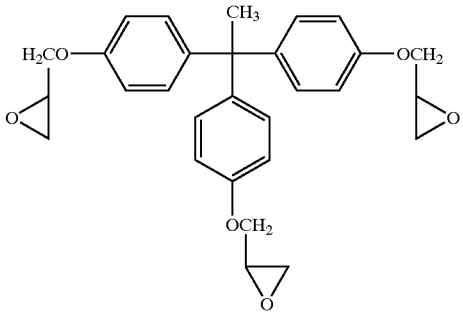
EP5
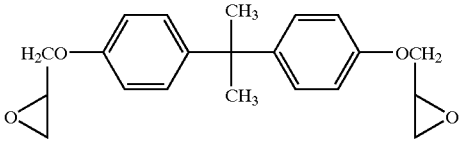
EP6
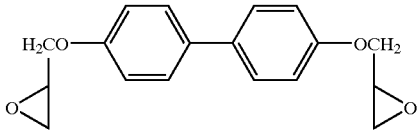
EP7
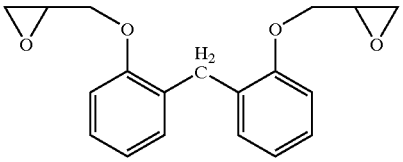
EP8
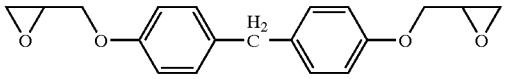
EP9
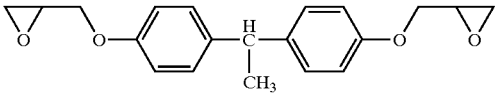
EP10
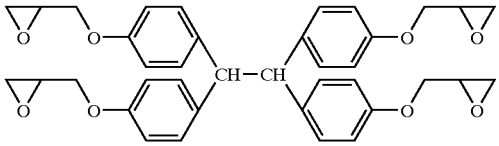
EP11
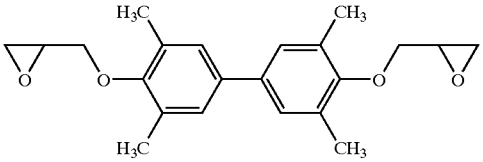
EP12
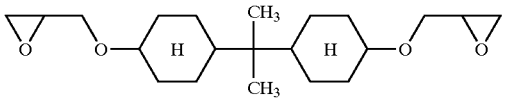
EP13
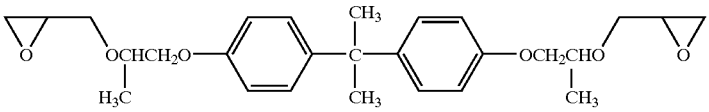
EP14
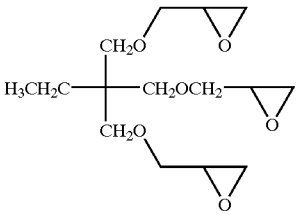
EP15
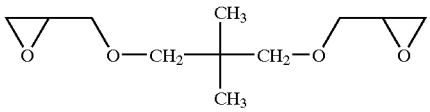
EP16
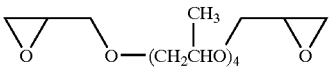
EP17
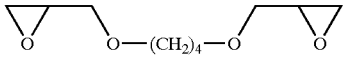
EP18
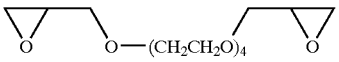
EP19
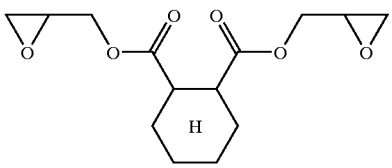

-continued

EP20

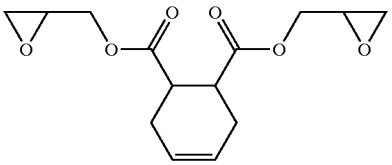

EP21

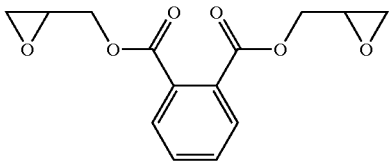

EP22

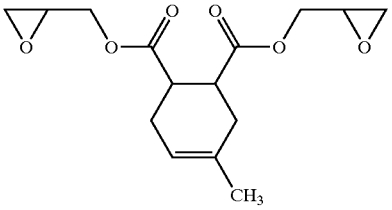

EP23

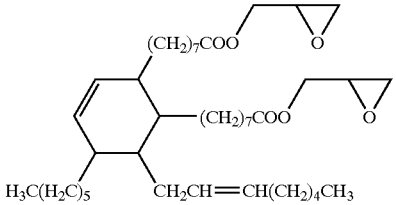

EP24

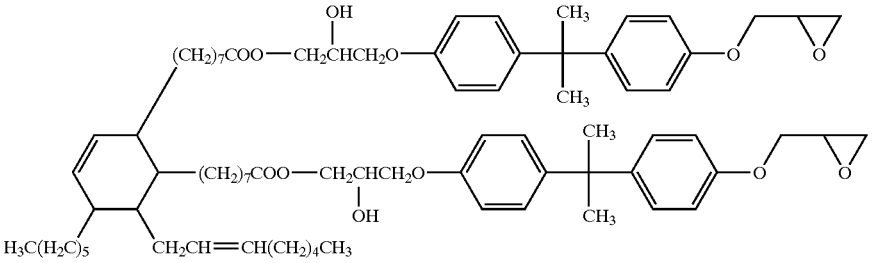

EP25

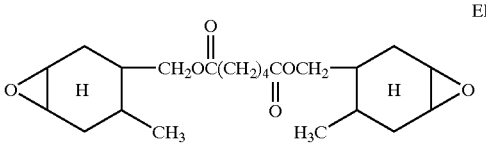

EP26

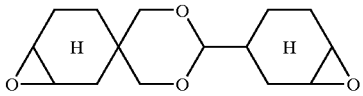

The proportions of these epoxy compounds added to the phenolic hydroxy groups of the resol type phenolic resin affects the film strength and discharge deterioration after curing, and accordingly can be varied in conformity with the operation environment of the electrophotographic photosensitive member and the demanded durability life; it is possible to add these epoxy compounds in the proportions of 3 to 70% to the phenolic hydroxy groups of the resol type phenolic resin, preferably 5 to 50%, more preferably 7 to 25%.

Additionally, the epoxy modified phenolic resin involved in the present invention can take a structure in which no heteroatoms other than oxygen are contained. In the combination of the epoxy modified phenolic resin having such a composition and a charge transport material, the charge transport capacity is scarcely inhibited so that particularly excellent electrophotographic characteristics can be obtained.

For the purpose of smooth charge transfer, it is preferable to make at least either one selected from a charge transport material and a conductive fine particle be contained in the layer constituting the outermost surface layer of the electrophotographic photosensitive member involved in the present invention, namely, the surface layer. In view of the compatibility of the charge transport material with the above described epoxy modified phenolic resin, it is preferable that the structure of the charge transport material is modified with hydroxy groups. As the hydroxy groups, suitable are hydroxyalkyl groups, hydroxyalkoxy groups or phenolic hydroxy groups.

Here, when the hydroxy group modifying the charge transport material is a hydroxyalkyl group or a hydroxyalkoxy group, the solubility to solvents can also be improved, and hence the charge transport capacity in the surface layer can be maintained at a high condition. Particularly, the numbers of the carbon atoms in the alkyl chains of these hydroxyalkyl group and hydroalkoxy group are preferably 1 to 8, more preferably 1 to 5, in view of the operability and solubility in the synthesis of the charge transport material.

Additionally, when the hydroxy group modifying the charge transport material is a phenolic hydroxy group, in the above described condensation reaction process of the polyhydroxymethylated bisphenol compounds, the hydrogen atoms in the ortho position or in the para position in relation to the phenolic hydroxy group can be reactive, and hence the crosslinking reaction occurs even in the case of a bisphenol compound and a charge transport material, and it is possible to derive an interrelated effect-like characteristic that the strength of the formed surface layer is improved.

In what follows are shown the specific examples (No. 1 to 60) of the charge transport material (CTM) containing hydroxy groups that can be used in the present invention, but the present invention is not solely limited to these compounds.

| No. | Examples of the Compound |
|---|---|
| 1 | 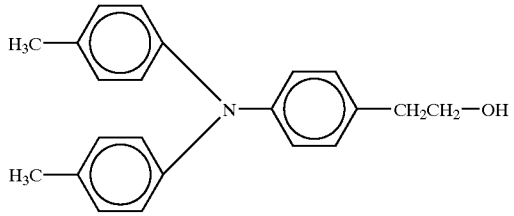 |
| 2 | 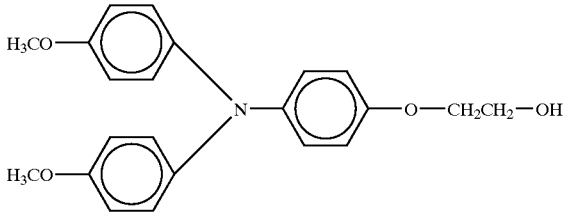 |
| 3 | 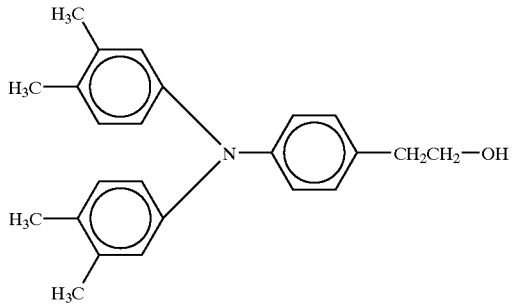 |
| 4 | 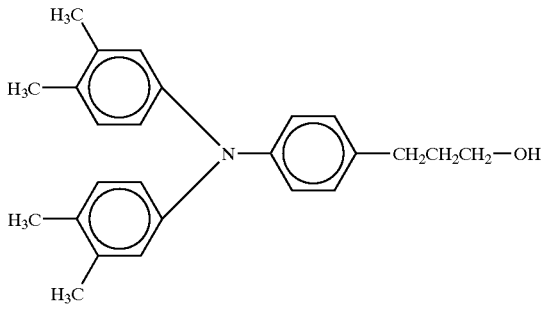 |
| 5 | 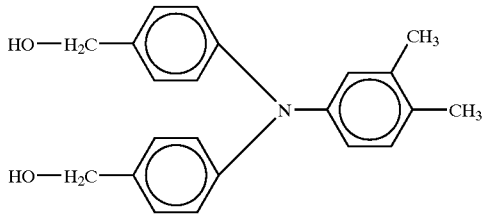 |
| 6 | 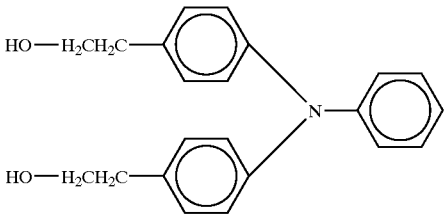 |

-continued
| No. | Examples of the Compound |
|---|---|
| 7 | 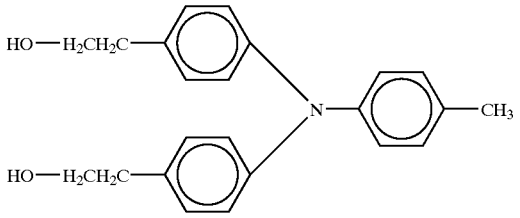 |
| 8 | 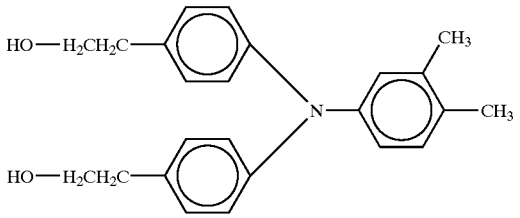 |
| 9 | 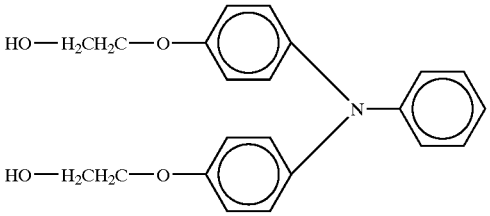 |
| 10 | 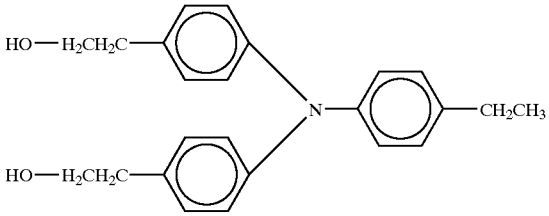 |
| 11 | 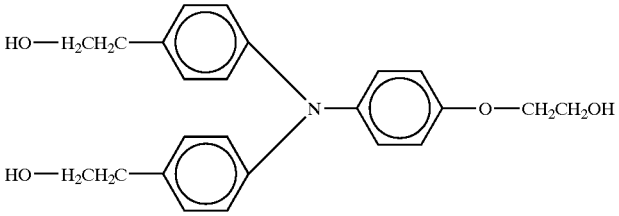 |
| 12 | 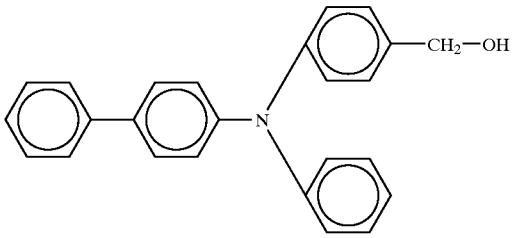 |

-continued
| No. | Examples of the Compound |
|---|---|
| 13 | 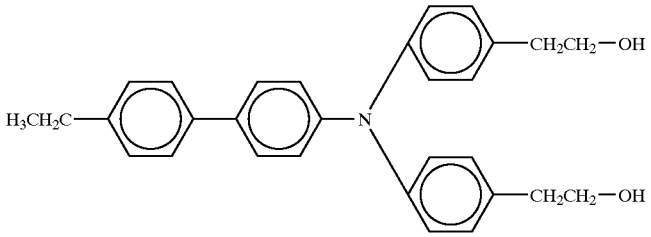 |
| 14 | 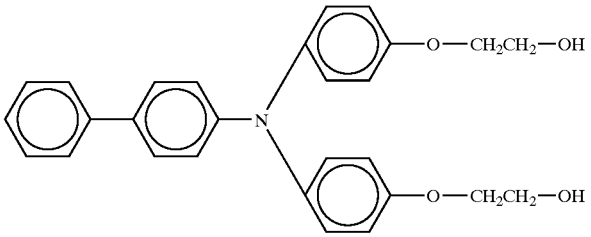 |
| 15 | 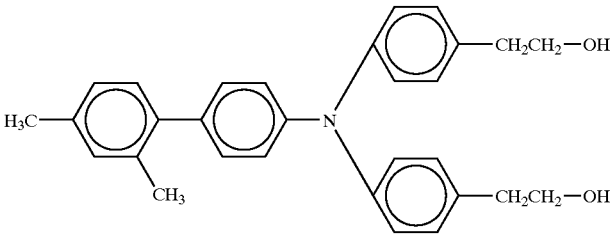 |
| 16 | 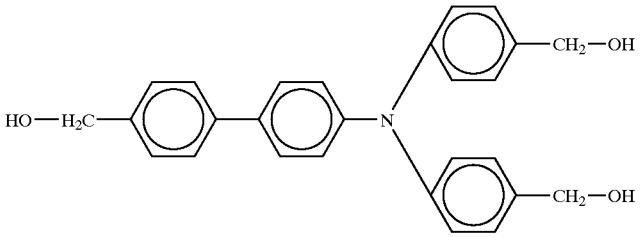 |
| 17 | 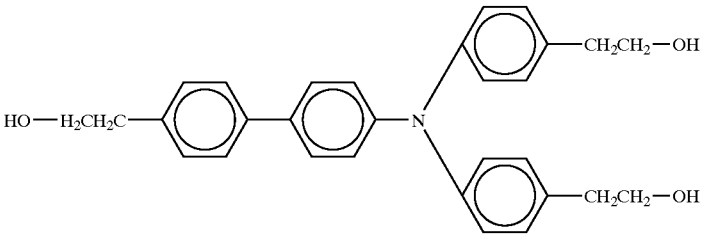 |
| 18 | 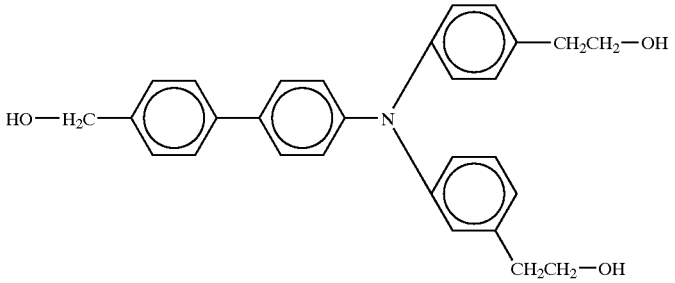 |

-continued
| No. | Examples of the Compound |
|---|---|
| 19 | 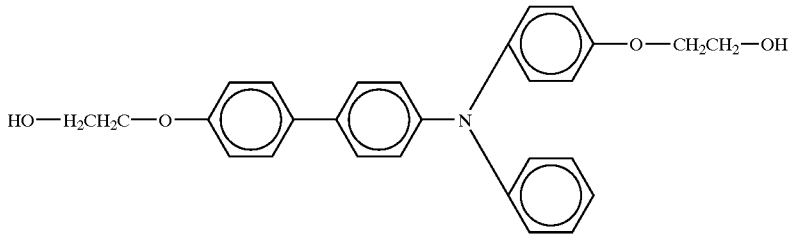 |
| 20 | 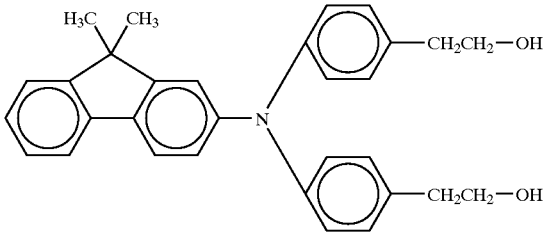 |
| 21 | 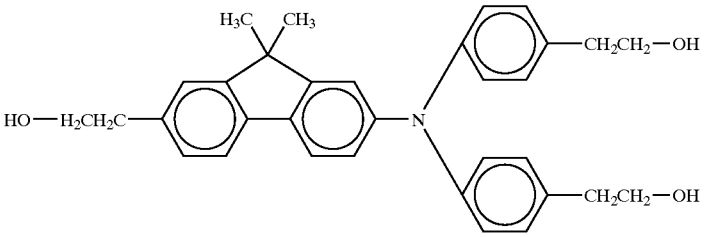 |
| 22 | 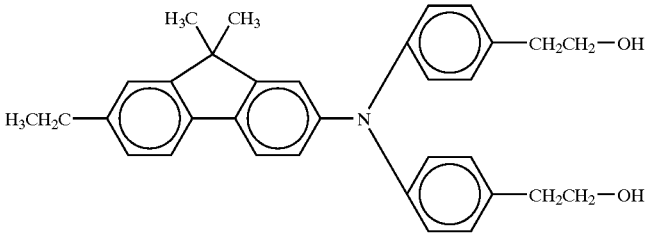 |
| 23 | 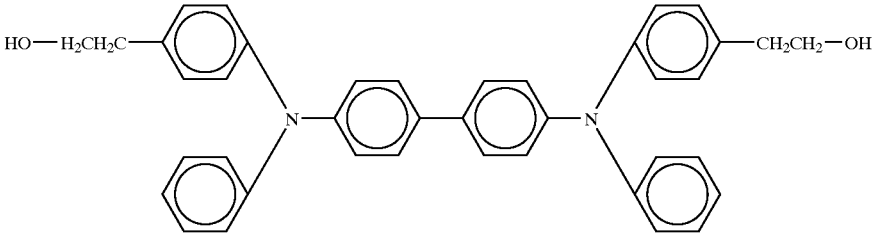 |
| 24 | 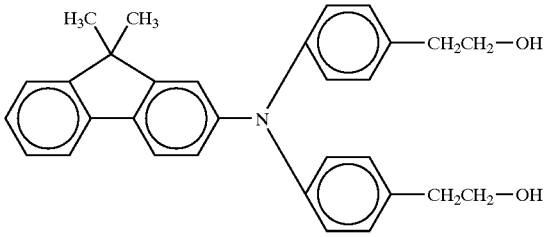 |

-continued
| No. | Examples of the Compound |
|---|---|
| 25 | 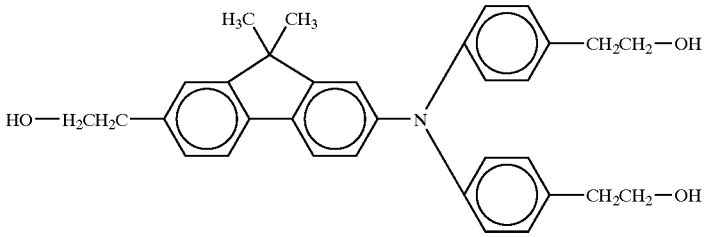 |
| 26 | 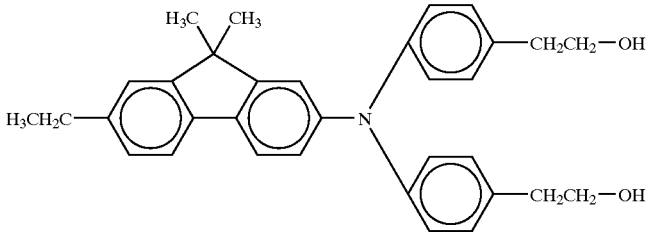 |
| 27 | 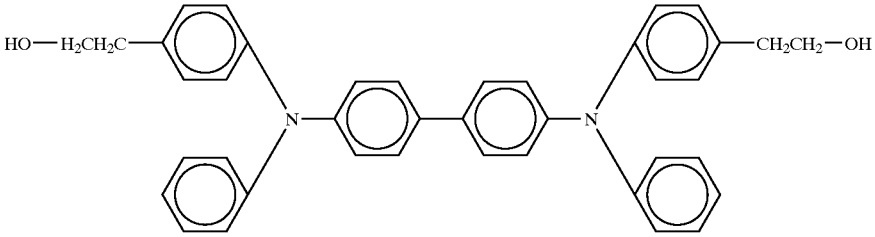 |
| 28 | 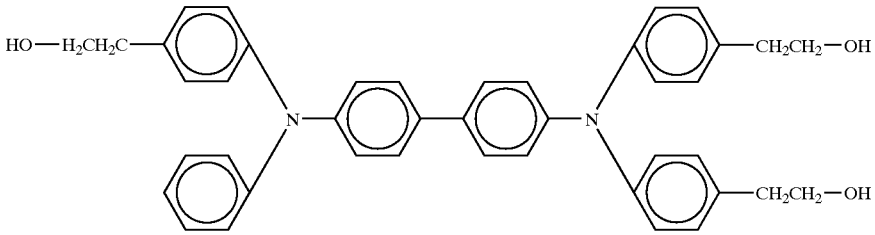 |
| 29 | 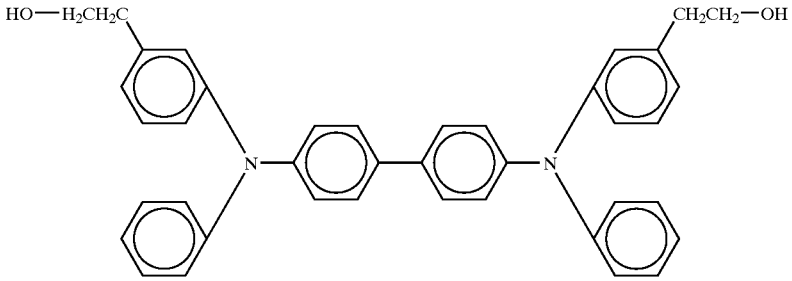 |
| 30 | 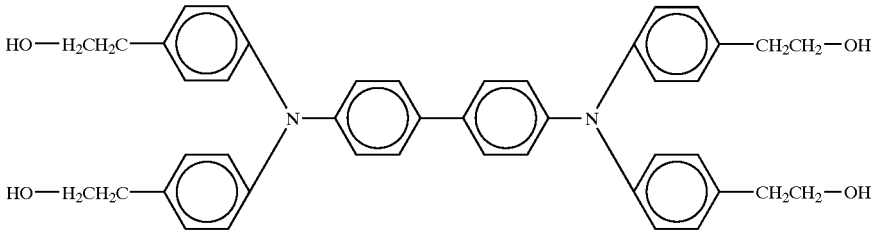 |

-continued
| No. | Examples of the Compound |
|---|---|
| 31 | 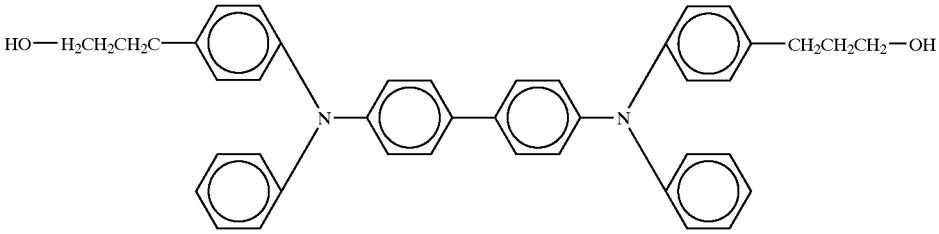 |
| 32 | 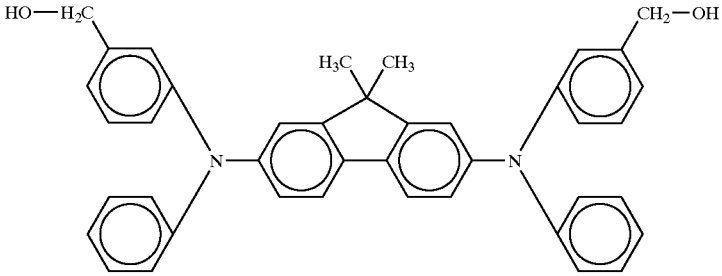 |
| 33 | 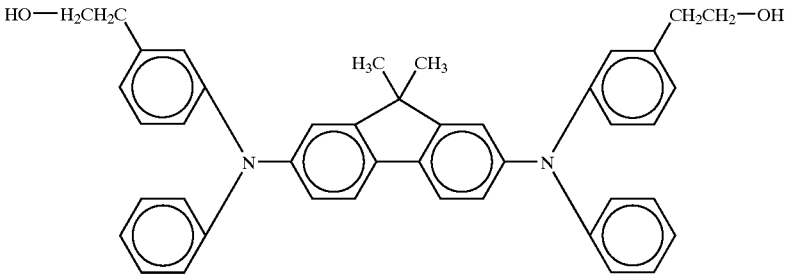 |
| 34 | 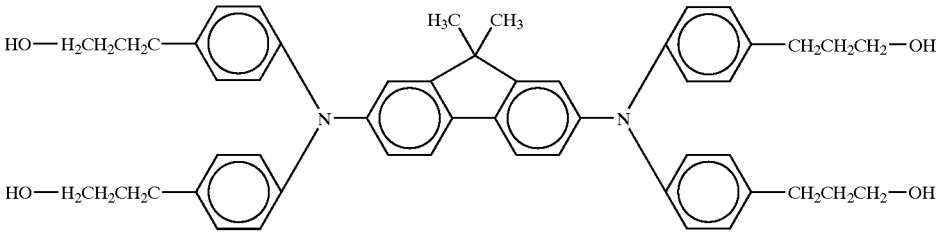 |
| 35 | 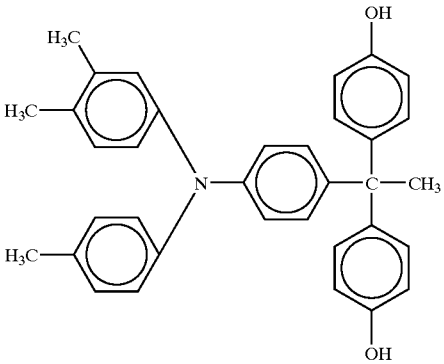 |

-continued
| No. | Examples of the Compound |
|---|---|
| 36 | 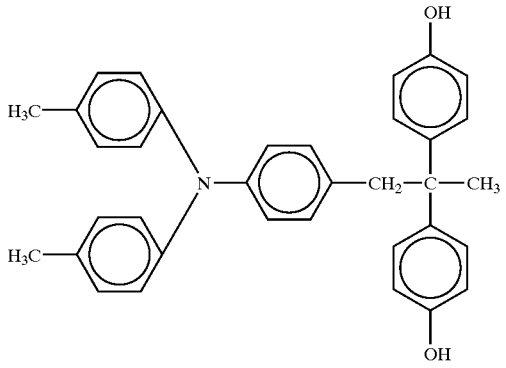 |
| 37 | 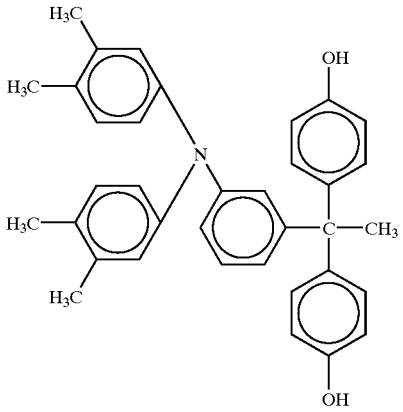 |
| 38 | 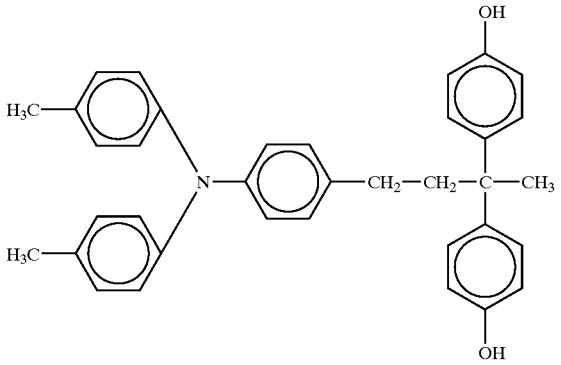 |
| 39 | 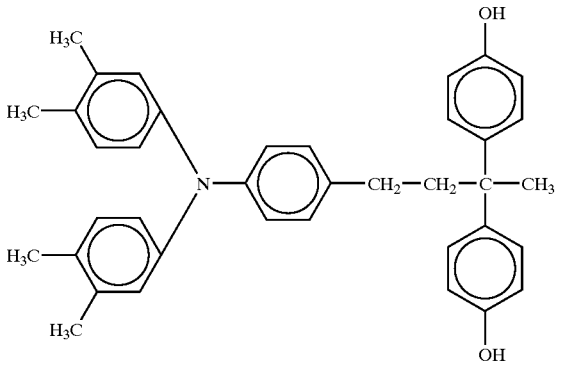 |

-continued
| No. | Examples of the Compound |
|---|---|
| 40 | 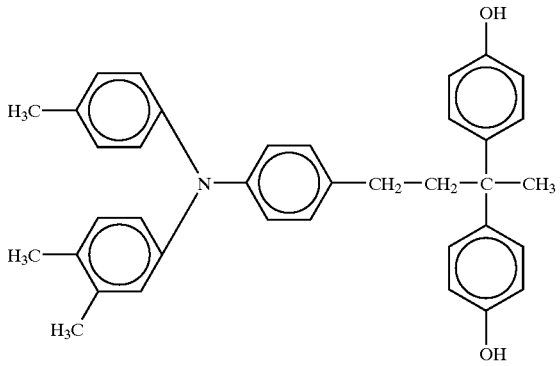 |
| 41 | 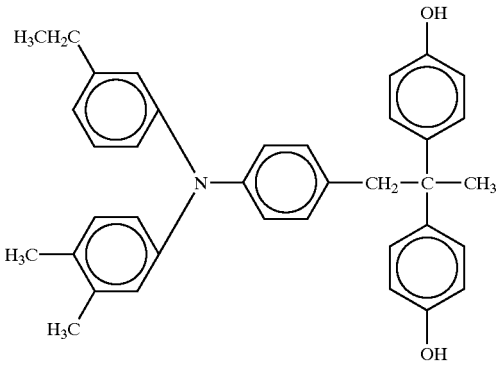 |
| 42 | 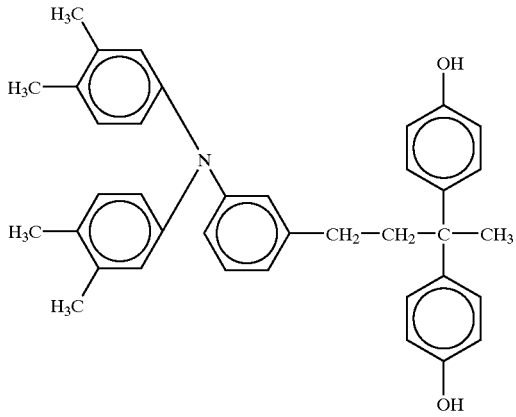 |
| 43 | 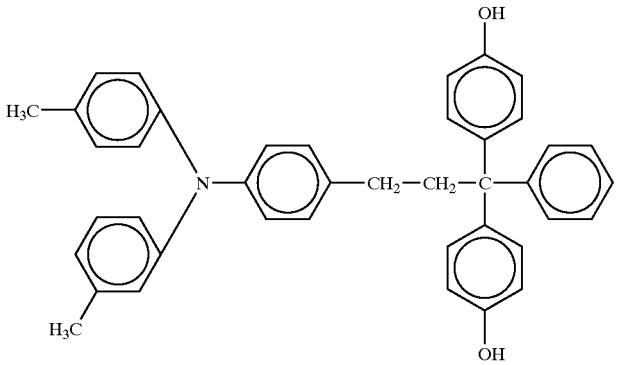 |

-continued
| No. | Examples of the Compound |
|---|---|
| 44 | 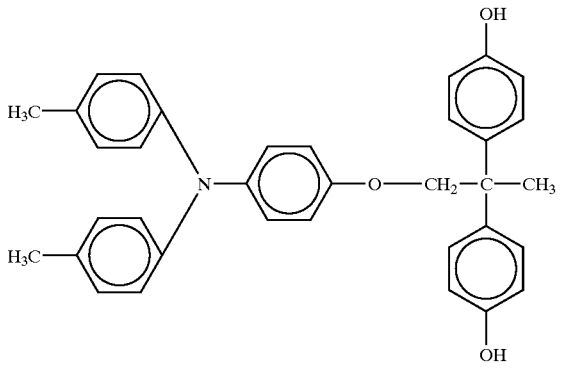 |
| 45 | 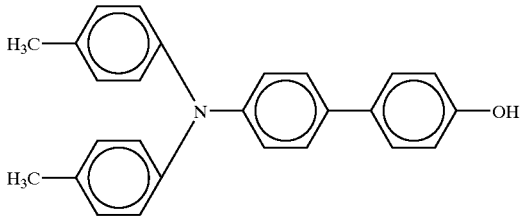 |
| 46 | 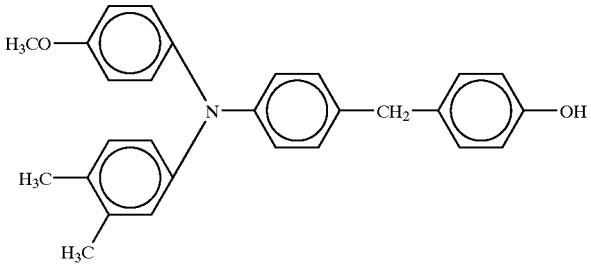 |
| 47 | 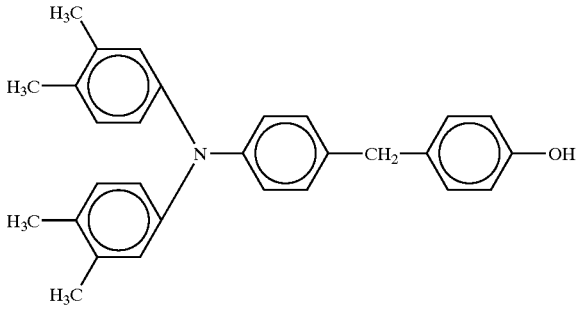 |
| 48 | 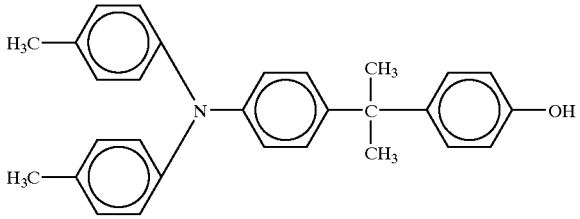 |

-continued
| No. | Examples of the Compound |
|---|---|
| 49 | 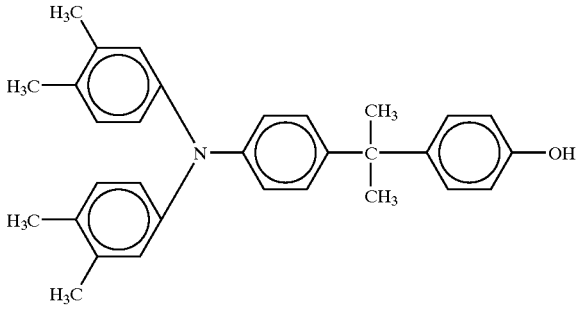 |
| 50 | 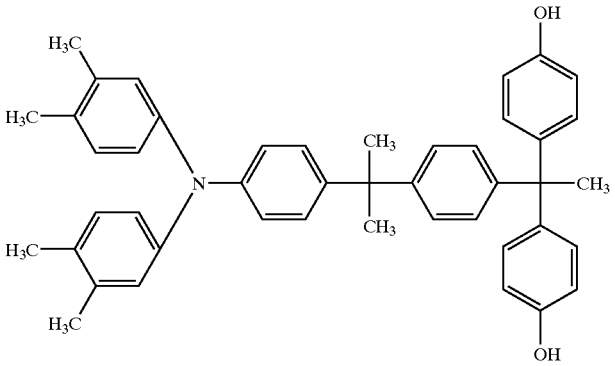 |
| 51 | 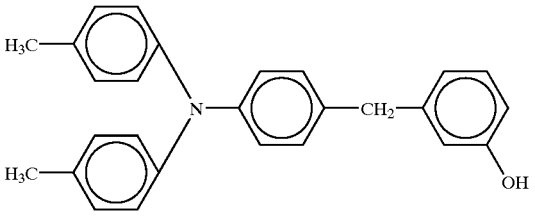 |
| 52 | 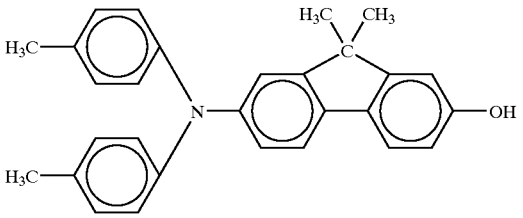 |
| 53 | 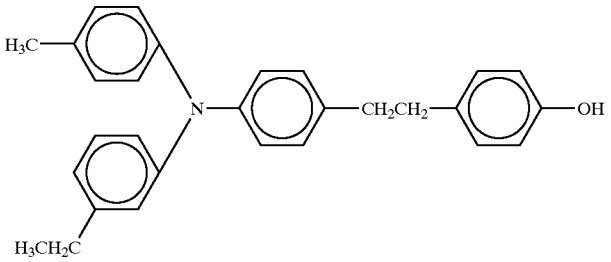 |

-continued
| No. | Examples of the Compound |
|---|---|
| 54 | 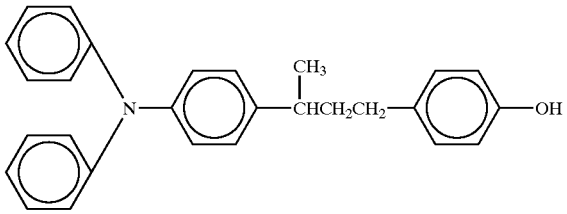 |
| 55 | 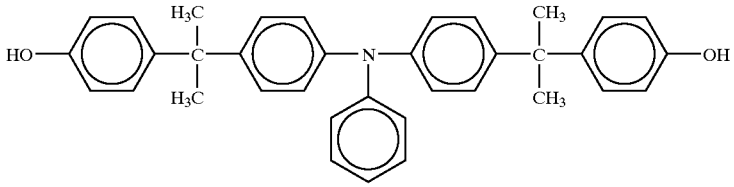 |
| 56 | 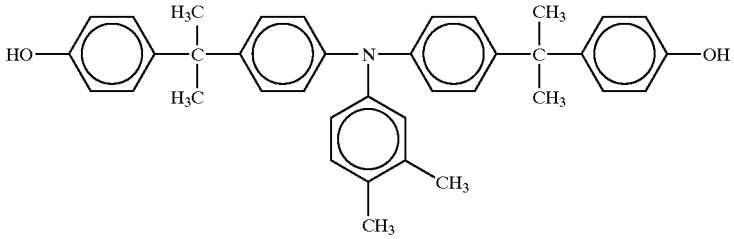 |
| 57 | 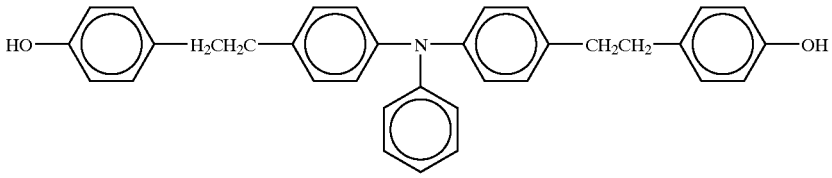 |
| 58 | 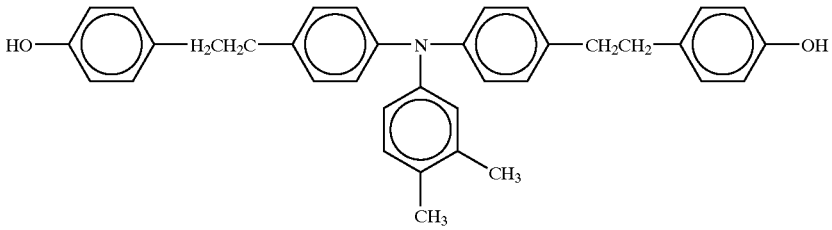 |
| 59 | 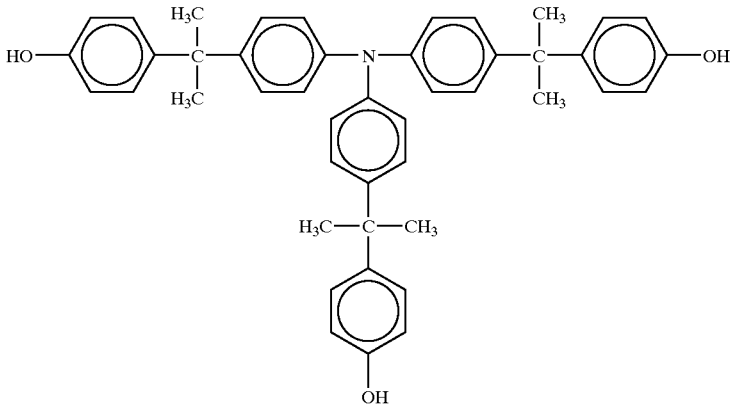 |

-continued

| No. | Examples of the Compound |
|---|---|
| 60 | 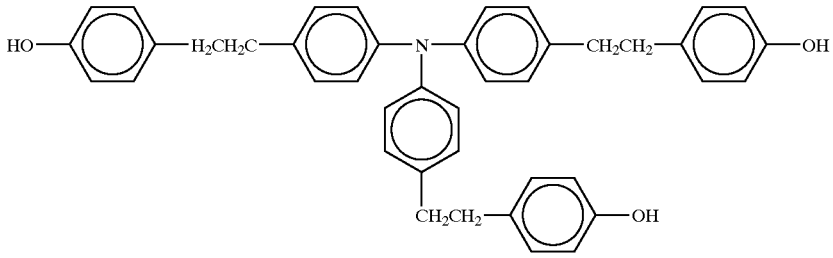 |

Examples of the conductive fine particles that can be used in the present invention can be selected from the materials conventionally well known in the art including, for example, zinc oxide, titanium oxide, tin oxide, antimony oxide, indium oxide, bismuth oxide, graphite, carbon black, tin oxide doped with indium, tin oxide doped with antimony, zirconium oxide and the like. Each one of these conductive particles alone can be used or two or more types of them can be used as a mixture.

The solvent used when the coating material for use in surface layer formation is prepared is preferably the one that satisfactorily dissolve the epoxy modified phenolic resin involved in the present invention and additionally the charge transport material, and furthermore, does not affect adversely the lower layer, such as the charge transport layer or the charge generating layer, constituting the surface on which the coating material for the surface layer is applied.

Accordingly, as the solvents, the following compounds can be used: alcohols including methanol, ethanol, and 2-propanol; ketones including acetone, cyclohexanone and methyl ethyl ketone (MEK); esters including methyl acetate and ethyl acetate; ethers including tetrahydrofuran and dioxane; and aromatic hydrocarbons including toluene and xylene; halogen containing hydrocarbons including chlorobenzene and dichloromethane. Furthermore, these compounds can be used as mixtures thereof.

Among these, the solvents most preferable for the phenolic resin form are alcohols including methanol, ethanol and 2-propanol.

The charge transport materials conventionally well known in the art are generally insoluble or scarcely soluble in alcohols as solvents, and hardly homogeneously dissolved in the epoxy modified phenolic resin of the present invention; however those charge transport materials which contain hydroxy groups are soluble in the solvents containing alcohols as main components, and scarcely damage the lower layers including the charge transport layer.

As the coating methods for the surface layer, the following general methods can be used: the dip-coating method, spray coating method, spinner coating method, roller coating method, Meyer ber coating method, blade coating method and the like.

In the present invention, antioxidant additives can be added in the surface layer for the purpose of preventing the surface layer deterioration and the like caused by adhesion of active materials such as ozone and NOx generated at the time of charging.

Description will be made below on the configuration of the electrophotographic photosensitive member involved in the present invention.

It is preferable that the electrophotographic photosensitive member involved in the present invention mainly has a laminated structure. The photosensitive member shown in FIG. 1A comprises a charge generating layer 3 and the charge transport layer 2 arranged in this order on a conductive support 4, and furthermore a curing charge transport type surface layer 1.

Figure 1B:
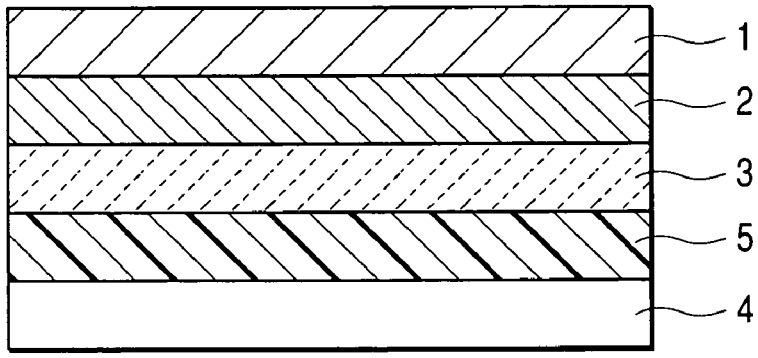
Figure 1C:
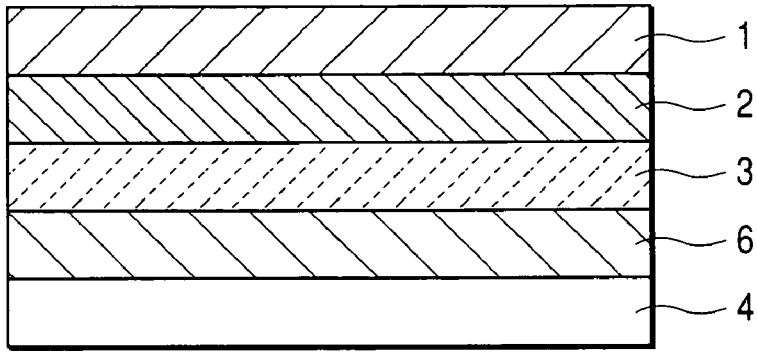

Additionally, as FIGS. 1B and 1C show, a binding layer 5 and furthermore a subbing layer 6 for the purpose of preventing interference fringe and the like may be arranged between the conductive support 4 and the charge generation layer 3.

Figure 1D:
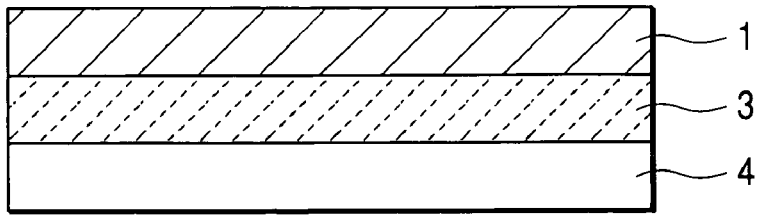

Additionally, FIG. 1D shows an example in which the charge generating layer 3 is arranged on the conductive support 4, and furthermore a curing charge transport type surface layer 1 of the present invention is arranged directly on the charge generation layer 3. In other words, FIG. 1D shows a configuration in which a charge transport layer makes up the surface layer.

The appropriate film thickness of the surface layer depends on the layer configuration of the photosensitive member, and it is preferable that the film thickness of the surface layer is appropriate for the purpose of improving the durability of the photosensitive member and suppressing the residual potential elevation caused by the arrangement of the surface layer. More specifically, for example, as FIGS. 1A, 1B and 1C show, when the surface layer 1 is arranged on the charge transport layer 2, the film thickness of the surface layer falls preferably within the range from 0.1 $\mu$m to 10 $\mu$m, particularly preferably within the range from 0.5 $\mu$m to 7 $\mu$m. Additionally, as FIG. 1D shows, when the surface layer 1 as the charge transport layer is arranged directly on the charge generating layer 3, the film thickness of the surface layer falls preferably within the range from 3 $\mu$m to 40 $\mu$m, particularly preferably within the range from 8 $\mu$m to 20 $\mu$m.

As the conductive support 4, the supports themselves having conductivity such as aluminum, aluminum alloys, stainless steel and the like can be used; additionally, the following supports can be used: the above described conductive support and plastic having the layer with a coating film formed by vacuum deposition of aluminum, aluminum alloy, indium oxide-tin oxide alloy and the like; a support made of paper or plastic impregnated with conductive fine particles (for example, carbon black, tin oxide, titanium oxide, silver particles and the like) together with an appropriate binder; and a plastic having conductive binder and the like.

Additionally, a binding layer (an adhesive layer) having barrier function and adhesive function can be arranged between the conductive support and the photosensitive layer.

The binding layer is formed for the purpose of improving the adhesion property and coating property of the photosensitive layer, protecting the support, covering the defects of the support, improving the property of charge injection from the support, protecting the photosensitive layer against the electric breakdown and the like. The binding layer can be formed by use of casein, polyvinyl alcohol, ethyl cellulose, ethylene-acrylic acid copolymer, polyamide, modified polyamide, polyurethane, gelatin, aluminum oxide and the like. The film thickness of the binding layer is preferably 5 μm or less, more preferably 0.1 to 3 μm.

Examples of the charge generating material used in the present invention include (1) azo based pigments such as monoazo, diazo and trisazo pigments; (2) phthalocyanine based pigments such as metal phthalocyanines and nonmetal phthalocyanines; (3) indigo based pigments such as indigo and thioindigo; (4) perylene based pigments such as perylenic acid anhydride and perylenic acid imide; (5) polycyclic quinone based pigments such as anthraquinone and perylene quinone; (6) squalilium dyes; (7) pyrilium salts and thiapyrilium salts; (8) triphenylmethane based dyes; (9) inorganic substances such as selenium, selenium-tellurium, and amorphous. silicon; (10) quinacridone pigments; (11) azulenium salt pigments; (12) cyanine dyes; (13) xanthene dyes; (14) quinoneimine dyes; (15) styryl dyes; (16) cadmium sulfide and (17) zinc oxide.

Examples of the binder resin used in the charge generation layer include polycarbonate resin, polyester resin, polyarylate resin, butyral resin, polystyrene resin, polyvinylacetal resin, diallylphthalate resin, acrylic resin, methacrylic resin, vinyl acetate resin, phenolic resin, silicone resin, polysulfone resin, styrene-butadiene copolymer resin, alkyd resin, epoxy resin, urea resin, and vinyl chloride-vinyl acetate copolymer resin; however, the binder resin is not limited to the above described resins. One type or two or more types of these resins can be used each alone, or as blended or copolymerized polymers.

The solvents used in the coating materials for use in the charge generating layer are selected in consideration of the solubilities and dispersion stabilities of the used resins and charge generating materials; as organic solvents, alcohols, sulfoxides, ketones, ethers, esters, aliphatic halogenated hydrocarbons or aromatic compounds can be used.

The charge generating layer 3 is formed as follows: the above described charge generating materials are well dispersed together with 0.3 to 4 times amount of a binder resin and a solvent by means of a homogenizer, ultrasonic wave, a ball mill, a sand mill, an attriter, a roll mill and the like, and applied and dried. Its thickness is preferably 5 μm or less, and particularly preferably falls within the range from 0.01 to 1 μm.

Additionally, to the charge generating layer 3, according to need, various sensitizers, antioxidant agents, ultraviolet absorbers, plasticizers, or the charge generating materials well known in the art can be added.

Examples of the used charge transport materials include various types of triarylamine compounds, various types of hydrazone compounds, various types of styryl compounds, various types of stilbene compounds, various types of pyrazoline compounds, various types of oxazole compounds, various types of thiazole compounds, various types of triarylmethane compounds and the like.

The binder resin used for formation of the charge transport layer 2 is preferably selected from acrylic resin, styrene based resin, polyester, polycarbonate resin, polyarylate, polysulfone, polyphenylene oxide, epoxy resin, polyurethane resin, alkyd resin, unsaturated resins and the like. The particularly preferable resins include polymethyl metharylate, polystyrene, styrene-acrylonitrile copolymer, polycarbonate resin and diallylphthalate resin.

The charge transport layer 2 is generally formed by dissolving the above described charge transport material and binder resin are dissolved in a solvent and applied. The mixing ratio between the charge transport material and the binder resin is of the order of 2:1 to 1:2. The solvents used are ketones such as acetone and methyl ethyl ketone; esters such as methyl acetate and ethyl acetate; aromatic hydrocarbons such as toluene and xylene; chlorine containing hydrocarbons such as chlorobenzene, chloroform and carbon tetrachloride; and the like. When the solution is applied, the following coating methods can be used: for example, the dip-coating method, spray coating method, spinner coating method and the like; drying can be conducted at 10° C. to 200° C., preferably at 20° C. to 150° C. for 5 minutes to 5 hours, preferably for 10 minutes to 2 hours by means of air blow drying or static drying.

The charge transport layer 2 is electrically connected to the above described charge generating layer, and accepts the charge carriers injected from the charge generating layer in the presence of the applied electric field, and has a function to transport these charge carriers to the interface associated with the protective layer. The film thickness of the charge transport layer cannot be made thicker than necessary owing to the limit for the charge carrier transport, and is preferably within the range from 5 to 40 μm, particularly preferably within the range from 7 to 30 μm.

Furthermore, in the charge transport layer 2, according to need, antioxidant agents, ultraviolet absorbers, plasticizers, or the charge transport materials well known in the art can be added.

In the present invention, furthermore, the above described protective layer is applied on the charge transport layer and cured to form a film, bringing to completion of the photosensitive member.

Figure 2:
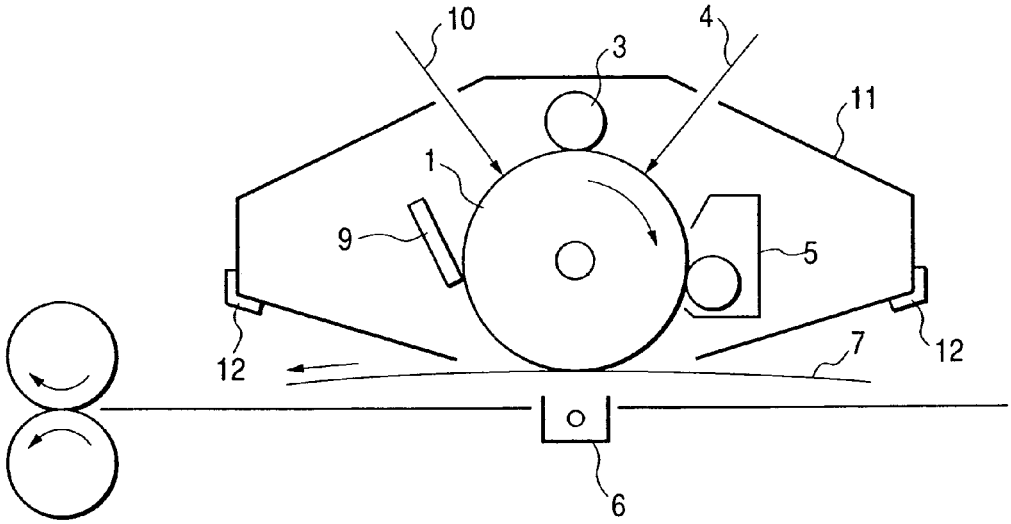
FIG. 2 is a schematic block diagram illustrating an example of an electrophotographic apparatus used in the present invention.

FIG. 2 shows a specific example of an electrophotographic apparatus in which the electrophotographic photosensitive member of the present invention is used. In this apparatus, a primary charging means 3, an image exposing means 4, a developing means 5, and a transfer means 6 are arranged on the circumference of the electrophotographic photosensitive member 1.

The image formation method is such that at the beginning, the primary charging means 3 is applied with a voltage, the surface of the photosensitive member 1 is charged, and the image exposing means 4 makes the image corresponding to the original matter undergo image exposure to the surface of the photosensitive member 1, forming an electrostatic latent image. In the next place, the electrostatic latent image on the photosensitive member 1 is thereby developed (enhanced visualization) by making the toner in the developing means 5 adhere to the photosensitive member 1. Then, the toner image formed on the photosensitive member 1 is transferred onto a transfer medium 7 such as a supplied sheet of paper by means of the transfer means 6, the toner untransferred to the transfer medium and remaining on the photosensitive member 1 is recovered by means of a cleaning means 9 and the like. In these years, the cleanerless system has also been developed so that the remaining toner can be directly recovered by means of a developing device and the like. Furthermore, a preliminary exposure by means of a preliminary exposing means 10 performs the neutralization of the photosensitive member, allowing the repeated use of the photosensitive member for image formation. Incidentally, the preliminary exposing means is not necessarily needed.

In the image formation system, as the light source of the image exposing means 4, a halogen lamp, a fluorescent lamp, a laser, an LED and the like can be used. According to need, other auxiliary processes may be added.

In the present invention, a set of plural members of the components, including the above described photosensitive member 1, primary charging means 3, developing means 5, cleaning means 9 and the like, may be integrated into one piece as a process cartridge, and the process cartridge may be made to be detachably mountable to the main body of an electrophotographic apparatus such as a copying machine and a printer. For example, at least one of the primary charging means 3, developing means 5, and cleaning means 9 is supported together with the photosensitive member 1 into one piece to form a cartridge, and the cartridge can be made to be a process cartridge 11 attachable to and detachable from the main body of an apparatus with the aid of a guiding device such as a pair of rails 12 provided in the main body of the apparatus. Additionally, when the electrophotography is a copying machine or a printer, the image exposing means 4 utilizes the reflected light from the original matter or the transmitted light from the original matter; or the image exposing means 4 utilizes the light irradiated by the laser beam scanning, LED array driving, liquid crystal shutter array driving and the like on the basis of the signals which are converted from the original matter.

EXAMPLES

Description will be made below on the present invention on the basis of the examples. However, the embodiments of the present invention are not limited to these examples.

Example 1

A cylinder made of aluminum (JIS A3003 aluminum alloy) of 260.5 mm in length and 30 mm in diameter was used as a support, on which a subbing layer of 0.5 μm in thickness was arranged by applying a 5 wt % methanol solution of a polyamide resin (brand name: Amilan CM8000, manufactured by Toray Industries, Inc.) by means of the dipping method.

Then, as a charge generating material, 4 parts (parts by weight, hereinafter ditto) of the oxytitanium phthalocyanine pigment represented by the following structural formula (5), having a crystalline type exhibiting strong peaks at the diffraction angles 2θ±0.2° of 9.6 and 27.2° in the Cu—Kα X ray diffraction spectrum, (5)

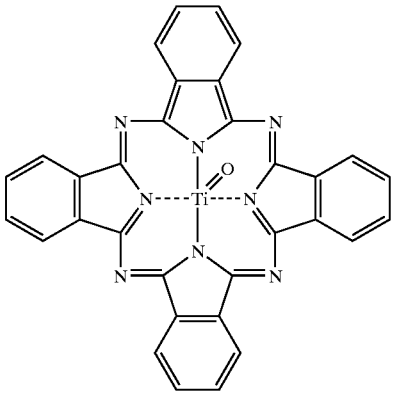

2 parts of polyvinyl butyral resin BX-1 (manufactured by Sekisui Chemical Co., Ltd.) and 110 parts of cyclohexanone were dispersed for 4.5 hours by means of a sand mill with 1 mm diameter glass beads. Subsequently dilution was made with 130 parts of ethyl acetate to yield a coating material for the charge generating layer.

The above described dispersion liquid was applied onto the above described subbing layer by means of the dipping method to form a charge generating layer of 0.18 μm in thickness.

In the next place, 7.5 parts of a charge transport material compound represented by the following structural formula (6), (6)

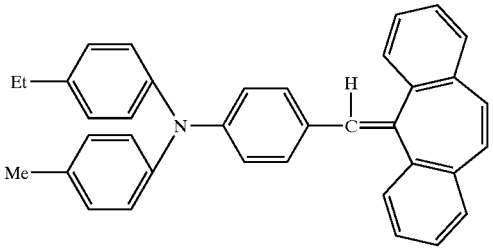

and 10 parts of bisphenol-Z polycarbonate (brand name: Z-200, manufactured by Mitsubishi Gas Chemical Co., Inc.) were dissolved in a mixture of 60 parts of monochlorobenzene and 20 parts of dichloromethane. The solution thus obtained was applied onto the above described charge generating layer by dip-coating, and subjected to hot air drying at 115° C. for 50 minutes to form a charge transport layer of 20 μm in thickness.

Then, as the binder resin prepolymer component for the surface layer, 10 parts of an epoxy modified phenolic resin obtained by adding the above illustrated compound EP19 to 15% of the phenolic hydroxy groups of a phenol-aldehyde resol type phenolic resin and 7 parts of the hydroxy group containing charge transport material represented by the above illustrated compound No. 12 were dissolved in 40 parts of ethanol to yield a coating solution for the surface layer; the solution was applied onto the above described charge transport layer, and subjected to hot air drying at 155° C. for one hour, to arrange a surface layer of 3 μm in film thickness. Here, the film thickness of the surface layer was measured by means of an interference film thickness meter (manufactured by Ohtsuka Electronics Co., Ltd.).

Incidentally, the stability of the coating solution for the surface layer was satisfactory in such a way that the coating solution was circulated for 20 days in an environment at a temperature of 23° C. and with a humidity of 50%, and then no significant variation was found in the liquid property.

Additionally, on the basis of JISK 5400, the adhesiveness between the surface layer and the lower layer was evaluated. Consequently, there was found no problem in the adhesiveness between the surface layer and the lower layer, namely, the charge transport layer in the present photosensitive member.

The evaluation of the electrophotographic characteristics of the photosensitive member was conducted by installing the photosensitive member in a laser beam printer (brand name: LBP-NX, manufactured by Canon Inc.). Incidentally, the laser beam printer concerned was remodeled in such a way that as for the electrophotographic sensitivity of the installed electrophotographic photosensitive member, the photosensitive member is charged so as for the dark area potential to be −700 V. The photosensitive member set at a dark area potential of −700 V is irradiated with a laser light beam of 780 nm in wavelength, and the amount of light needed for varying the potential from −675 V to −175 V was measured to be taken as the sensitivity. The potential after the additional irradiation of light in the amount of 20 $\mu J/cm^2$ was measured as the residual potential Vr.

Furthermore, using the same laser beam printer, the durability test was conducted against 10,000 sheets in the environment such that the temperature was 30° C. and the humidity was 80%, and then the abrasion amount was measured and the output image qualities were compared.

Example 2

An electrophotographic photosensitive member was produced in the same manner as that in Example 1 except that the charge generating material was replaced with a crystalline hydroxygallium phthalocyanine which has intense peaks at 7.5°, 9.9°, 16.3°, 18.6°, 25.1° and 28.3° of the Bragg angle, 2θ±0.2°.

Examples 3 to 10

Electrophotographic photosensitive members were produced in the same manner as that in Example 2 except that the resin used for the surface layer was replaced with the epoxy modified resol type phenolic resins respectively obtained by use of the epoxy compounds shown in Table 1 presented below.

Examples 11 to 18

Electrophotographic photosensitive members were produced in the same manner as that in Example 3 except that at least one item selected from the protective layer thickness, the charge transport material, and the epoxy modification ratio in the epoxy modified resol type resin was varied as shown in Table 1.

Example 19

An electrophotographic photosensitive member was produced in the same manner as that in Example 1 except that the hydroxy group containing charge transport material was replaced with the illustrated compound No. 33.

Comparative Example 1

A photosensitive member was produced in the same manner as that in Example 1 except that a novolac type phenolic resin not subjected to epoxy modification (brand name: CMK-2400, manufactured by Showa Highpolymer Co., Ltd.) was used as the protective layer resin, and the charge transport material No. 12 was replaced with the charge transport material No. 16.

Comparative Example 2

A photosensitive member was produced in the same manner as that in Example 1 except that a resol type phenolic resin modified (modification ratio: 30%) with the epoxy compound illustrated as the compound EP10 was used as the protective layer resin, and no charge transport material was made to be contained.

Comparative Example 3

In Example 2, 5 parts of a solution (solid content: 67 wt %) of the buret modified substance represented by the following structural formula (7)

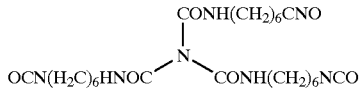

(7)

and the above described, illustrated compound No. 16 as the charge transport material were dissolved in 50 parts of methyl ethyl ketone to prepare a coating solution, the coating solution was applied onto the charge transport layer by the spray coating method, dried at ambient temperature for 5 minutes, and then heated at 155° C. for 60 minutes to form a surface layer of 3 $\mu$m in thickness. The mixing ratio of the coating solution was such that the solution was prepared so as for the ratio of [the total number of moles of the hydroxy groups in the illustrated compound No. 16]:[the total number of moles of the isocyanate groups shown in the above formula (7)] to be approximately 47:53.

Comparative Example 4

An electrophotographic photosensitive member was produced in the same manner as that in Comparative Example 1 except that a simple blend material composed of 7 parts of the novolac type phenolic resin not subjected to epoxy modification (brand name: CMK-2400, manufactured by Showa Highpolymer Co., Ltd.) and 3 parts of the following epoxy compound (8) was used as the protective layer resin.

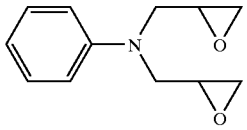

(8)

Comparative Example 5

An electrophotographic photosensitive member was produced in the same manner as that in Example 1 except that no protective layer was arranged.

Comparative Example 6

A photosensitive member was produced in the same manner as that in Example 19 except that the epoxy modified resol type phenolic resin was replaced with an alkaline resol type phenolic resin (manufactured by Asahi Organic Chemicals Industry Co., Ltd., HP-8300).

The protective layer compositions for Examples 1 to 19 and Comparative Examples 1 to 6 were collected in Table 1.

TABLE 1

| | Epoxy compound | Modification ratio (%) * | CTM | Film thickness ($\mu$m) |
|---|---|---|---|---|
| Example 1 | EP19 | 15 | No. 12 | 3 |
| 2 | EP19 | 15 | No. 12 | 3 |
| 3 | EP12 | 15 | No. 12 | 3 |
| 4 | EP22 | 15 | No. 12 | 3 |
| 5 | EP23 | 15 | No. 12 | 3 |
| 6 | EP18 | 15 | No. 12 | 3 |

TABLE 1-continued

| | Epoxy compound | Modification ratio (%) * | CTM | Film thickness (μm) |
|---|---|---|---|---|
| 7 | EP25 | 15 | No. 12 | 3 |
| 8 | EP15 | 15 | No. 12 | 3 |
| 9 | EP13 | 15 | No. 12 | 3 |
| 10 | EP14 | 15 | No. 12 | 3 |
| 11 | EP12 | 15 | No. 12 | 3 |
| 12 | EP12 | 15 | No. 12 | 6 |
| 13 | EP12 | 35 | No. 12 | 3 |
| 14 | EP12 | 10 | No. 4 | 3 |
| 15 | EP12 | 10 | No. 30 | 3 |
| 16 | EP12 | 10 | No. 37 | 3 |
| 17 | EP12 | 10 | No. 50 | 3 |
| 18 | EP12 | 10 | No. 56 | 3 |
| 19 | EP19 | 15 | No. 33 | 3 |
| Comparative Example 1 | None | — | No. 16 | 3 |
| 2 | EP10 | 30 | None | 3 |
| 3 | Isocyanate | — | No. 16 | 3 |
| 4 | (Blend) | 20 | No. 16 | 3 |
| 5 | No protective layer | — | — | 0 |
| 6 | Alkaline resol | — | No. 33 | 3 |

* Modification ratio: The ratio of the phenolic OH group to which an epoxy group is added based on the total number of phenolic OH group.

The Protective Layer Compositions for Examples 1 to 19 and Comparative Examples 1 to 6

These electrophotographic photosensitive members and coating materials for the protective layers were evaluated on the same test methods as those described in Example 1. Table 2 collects the evaluation results obtained by comparing the results associated with the adhesiveness between the protective layer and the photosensitive layer, the stability of the protective layer coating material, the sensitivity as the electrophotographic photosensitive member, and furthermore, the image quality after the durability test by means of the laser beam printer in the environment such that the temperature was 30° C. and the humidity was 80%, and the abrasion amount of the surface layer per 10,000 sheets.

Incidentally, the evaluations of the adhesiveness and the stability of a coating material were conducted according to the following standards. Adhesiveness: Evaluation was made on the basis of the evaluation method of the adhesiveness of a coating film defined in JIS K5400 (a crosscut method) (corresponding to ISO 2409:1992), and the results obtained were graded according to the following standards:

A: No film peeling was observed.

B: The fraction of the area of the peeled part was less than 10% of the total area.

C: The fraction of the area of the peeled part was 10% or more of the total area.

Stability of a coating material:

A: In a coating material circulation test run over a period of 20 days, no variation was found with respect to the viscosity, gelation, coagulation, sedimentation and turbidity of the coating material, even after the elapsed time of 20 days.

B: In a coating material circulation test run over a period of 20 days, some variations were found with respect to the viscosity, gelation, coagulation, sedimentation and turbidity of the coating material, after the elapsed time of 20 days, which variations caused no significant effect on the protective layer coatability.

C: In a coating material circulation test run over a period of 20 days, variations were found with respect to the viscosity, gelation, coagulation, sedimentation and turbidity of the coating material, after the elapsed time of 20 days, which variations caused effects on the protective layer coatability or the film condition of the protective layer subsequent to coating.

TABLE 2

| | Sensitivity [μJ/cm$^2$] | Residual potential [Vr] | Adhesiveness | Coating material stability | Abrasion amount [μm] | Image quality |
|---|---|---|---|---|---|---|
| Example 1 | 0.45 | 46 | A | A | 0.52 | Good |
| 2 | 0.35 | 36 | A | A | 0.51 | Good |
| 3 | 0.34 | 34 | A | A | 0.41 | Good |
| 4 | 0.36 | 37 | A | A | 0.51 | Good |
| 5 | 0.33 | 34 | A | A | 0.55 | Good |
| 6 | 0.32 | 33 | A | A | 0.52 | Good |
| 7 | 0.37 | 38 | A | A | 0.62 | Fine seams |
| 8 | 0.36 | 37 | B | A | 0.59 | Good |
| 9 | 0.31 | 32 | A | A | 0.55 | Good |
| 10 | 0.35 | 36 | A | B | 0.37 | Slight blurring |
| 11 | 0.28 | 29 | A | A | 0.42 | Good |
| 12 | 0.42 | 43 | A | A | 0.40 | Good |
| 13 | 0.44 | 45 | A | B | 0.37 | Slight blurring |
| 14 | 0.31 | 32 | A | A | 0.42 | Good |
| 15 | 0.32 | 33 | A | A | 0.44 | Good |
| 16 | 0.33 | 34 | A | A | 0.38 | Good |
| 17 | 0.31 | 32 | A | A | 0.35 | Good |
| 18 | 0.32 | 33 | A | A | 0.36 | Good |
| 19 | 0.43 | 46 | A | A | 0.64 | Fine seams |
| Comparative Example 1 | 0.43 | 44 | C | A | 7.45 | Blurring, Fogging |
| 2 | Unmeasurable | 295 | B | B | 0.56 | Faint density |
| 3 | 0.44 | 45 | C | C | 2.78 | Blurring, Fogging |
| 4 | 0.41 | 42 | C | A | 6.56 | Seams, Blurring |

TABLE 2-continued

| | Sensitivity [$\mu J/cm^2$] | Residual potential [Vr] | Adhesiveness | Coating material stability | Abrasion amount [$\mu m$] | Image quality |
|---|---|---|---|---|---|---|
| 5 | 0.25 | 24 | — | — | 9.23 | Fogging, Seams |
| 6 | 0.45 | 46 | B | A | 1.28 | Slight nonuniformity, Seams |

The Evaluation Results of Examples 1 to 19 and Comparative Examples 1 to 6

From these results, when the resin of the present invention is used as the surface protective layer, no remarkable sensitivity degradation as the electrophotographic photosensitive member is observed, and the durability strength in the electrophotographic process can be remarkably improved. Furthermore, the adhesiveness to the lower layer, namely, the charge transport layer can be sufficiently maintained. Additionally, it has been found that when a coating material for the surface protective layer is prepared by using the resin of the present invention, the stability of the coating material is sufficiently high so that no trouble is caused even in the continuous production.

Examples 20

A photosensitive member was produced in the same manner as that in Example 2 except that the coating material for the surface layer was prepared as follows.

A dispersion solution was prepared by adding 100 parts of ethanol to 25 parts of an antimony containing tin oxide fine particle (brand name: T-1, manufactured by Mitsubishi Material Co., Ltd.) of 0.02 $\mu m$ in average particle size, subjected to surface treatment with (3,3,3-trifluoropropyl) trimethoxysilane, and by dispersing for 96 hours by means of a sand mill apparatus; and 15 parts of the epoxy modified phenolic resin used in Example 2 was dissolved in this dispersion solution, to yield the coating material for the surface layer. The charge transport layer was dip-coated with this coating material, subjected to heat treatment at 155° C. for one hour, to yield a surface layer of 3 $\mu m$ in thickness.

Example 21

A photosensitive member was produced in the same manner as that in Example 20 except that the film thickness of the surface layer was made to be 1 $\mu m$.

Example 22

A photosensitive member was produced in the same manner as that in Example 20 except that the film thickness of the surface layer was made to be 6 $\mu m$.

Examples 23 to 32

Electrophotographic photosensitive members were produced in the same manner as that in Example 20 except that the epoxy modified resol type phenolic resins, shown in Table 3, obtained by using the epoxy compounds were respectively used for the photosensitive members as the resins used for the outermost surface layer, and furthermore, the protective layer film thickness and the epoxy modification ratio were varied as shown in Table 3.

Example 33

A photosensitive member was produced in the same manner as that in Example 20 except that the coating material for the surface layer was prepared as follows.

A dispersion solution was prepared by adding 100 parts of ethanol to 25 parts of an antimony containing tin oxide fine particle (brand name: T-1, manufactured by Mitsubishi Material Co., Ltd.) of 0.02 $\mu m$ in average particle size, subjected to surface treatment with (3,3,3-trifluoropropyl) trimethoxysilane, and by dispersing for 96 hours by means of a sand mill apparatus; the dispersion solution was added with 8 parts of tetrafluoroethylene resin particle (PTFE particle, brand name: Lubron L-2, manufactured by Daikin Industries, Ltd.), and further subjected to dispersion treatment for one hour; and 15 parts of the epoxy modified phenolic resin used in Example 20 was dissolved in the dispersion solution, to yield the coating material for the surface layer. The charge transport layer was dip-coated with this coating material, subjected to heat treatment at 155° C. for one hour, to yield a surface layer of 3 $\mu m$ in thickness.

Examples 34 to 45

Electrophotographic photosensitive members were produced in the same manner as that in Example 33 except that the epoxy modified resol type phenolic resins, shown in Table 3, obtained by using the epoxy compounds were respectively used for the photosensitive members as the resins used for the surface layer, and furthermore, the protective layer film thickness and the epoxy modification ratio were varied as shown in Table 3.

Comparative Example 7

A photosensitive member was produced in the same manner as that in Example 20 except that the protective layer was arranged as follows.

A dispersion solution was prepared by adding 100 parts of methyl ethyl ketone to 25 parts of an antimony containing tin oxide fine particle (brand name: T-1, manufactured by Mitsubishi Material Co., Ltd.) of 0.02 $\mu m$ in average particle size, subjected to surface treatment with (3,3,3-trifluoropropyl) trimethoxysilane, and by dispersing for 96 hours by means of a sand mill apparatus; 7.2 parts of the solution (the solid content: 67 wt %) of the buret modified substance represented by the above shown structural formula (7) and 10 parts of the novolac type phenolic resin (brand name: CMK-2400, manufactured by Showa Highpolymer Co., Ltd.) were dissolved in the dispersion solution, to prepare the coating solution; and the charge transport layer was coated with this coating material by means of the spray coating method, dried at ambient temperature for 5 minutes, and subjected to heat treatment at 155° C. for 60 minutes, to yield a surface layer of 3 μm in thickness.

Comparative Example 8

An electrophotographic photosensitive member was produced in the same manner as that in Example 20 except that a simple blend material composed of 7 parts of the phenolic resin not subjected to epoxy modification (brand name: CMK-2400, manufactured by Showa Highpolymer Co., Ltd.) and 3 parts of the above described epoxy compound (8) was used as the protective layer resin.

Comparative Example 9

An electrophotographic photosensitive member was produced in the same manner as that in Example 20 except that the alkaline resol type phenolic resin (brand name: HP-8300, manufactured by Asahi Organic Chemicals Industry Co., Ltd.) was used as the resin for the protective layer.

TABLE 3

| | Epoxy compound | Modification on ratio (%) * | Film thickness (μm) | Additive |
|---|---|---|---|---|
| Example 20 | EP19 | 15 | 3 | $SnO_2$ particle |
| 21 | EP19 | 15 | 1 | $SnO_2$ particle |
| 22 | EP19 | 15 | 6 | $SnO_2$ particle |
| 23 | EP19 | 35 | 3 | $SnO_2$ particle |
| 24 | EP12 | 15 | 2 | $SnO_2$ particle |
| 25 | EP12 | 15 | 4 | $SnO_2$ particle |
| 26 | EP12 | 35 | 3 | $SnO_2$ particle |
| 27 | EP1 | 15 | 3 | $SnO_2$ particle |
| 28 | EP14 | 15 | 3 | $SnO_2$ particle |
| 29 | EP16 | 15 | 3 | $SnO_2$ particle |
| 30 | EP20 | 15 | 3 | $SnO_2$ particle |
| 31 | EP24 | 15 | 3 | $SnO_2$ particle |
| 32 | EP26 | 15 | 3 | $SnO_2$ particle |
| 33 | EP19 | 15 | 3 | $SnO_2$ particle, PTFE particle |
| 34 | EP19 | 15 | 1 | $SnO_2$ particle, PTFE particle |
| 35 | EP19 | 15 | 6 | $SnO_2$ particle, PTFE particle |
| 36 | EP19 | 35 | 3 | $SnO_2$ particle, PTFE particle |
| 37 | EP12 | 15 | 2 | $SnO_2$ particle, PTFE particle |
| 38 | EP12 | 15 | 4 | $SnO_2$ particle, PTFE particle |
| 39 | EP12 | 35 | 3 | $SnO_2$ particle, PTFE particle |
| 40 | EP1 | 15 | 3 | $SnO_2$ particle, PTFE particle |
| 41 | EP14 | 15 | 3 | $SnO_2$ particle, PTFE particle |
| 42 | EP16 | 15 | 3 | $SnO_2$ particle, PTFE particle |
| 43 | EP20 | 15 | 3 | $SnO_2$ particle, PTFE particle |
| 44 | EP23 | 15 | 3 | $SnO_2$ particle, PTFE particle |
| 45 | EP25 | 15 | 3 | $SnO_2$ particle, PTFE particle |
| Comparative Example 7 | Isocyanate | 15 | 3 | $SnO_2$ particle |
| 8 | Blend | 15 | 3 | $SnO_2$ particle |
| 9 | Alkaline resol | 15 | 3 | $SnO_2$ particle |

* Modification ratio: The ratio of the phenolic OH group to which the epoxy group is added based on the total number of phenolic OH group.

The Protective Layer Compositions for Examples 20 to 45 and Comparative Examples 7 to 9

These electrophotographic photosensitive members and coating materials for the protective layers were evaluated on the same test methods as those described in Example 1. Table 4 collects the evaluation results obtained by comparing the results associated with the adhesiveness between the protective layer and the photosensitive layer, the stability of the protective layer coating material, the sensitivity as the electrophotographic photosensitive member, the residual potential (Vr), and furthermore, the image quality after the durability test by means of the laser beam printer in the environment such that the temperature was 30° C. and the humidity was 80%, and the abrasion amount of the surface layer per 10,000 sheets. Incidentally, the evaluation standards of the adhesiveness and the stability of a coating material were the same as those described above.

TABLE 4

| | Sensitivity [$\mu$J/cm$^2$] | Residual potential [Vr] | Adhesiveness | Coating material stability | Abrasion amount [$\mu$m] | Image quality |
|---|---|---|---|---|---|---|
| Example 20 | 0.48 | 49 | A | A | 0.48 | Good |
| 21 | 0.32 | 33 | A | A | 0.49 | Good |
| 22 | 0.58 | 58 | A | A | 0.47 | Good |
| 23 | 0.51 | 52 | A | A | 0.44 | Slight blurring |
| 24 | 0.41 | 42 | A | A | 0.35 | Good |
| 25 | 0.52 | 53 | A | A | 0.34 | Good |
| 26 | 0.52 | 53 | A | A | 0.31 | Slight blurring |
| 27 | 0.47 | 48 | A | A | 0.45 | Faint seams |
| 28 | 0.46 | 47 | B | A | 0.38 | Slight blurring |
| 29 | 0.48 | 49 | A | A | 0.42 | Good |
| 30 | 0.47 | 48 | A | A | 0.52 | Good |
| 31 | 0.45 | 46 | A | B | 0.41 | Good |
| 32 | 0.48 | 49 | B | A | 0.45 | Faint seams |
| 33 | 0.47 | 48 | A | A | 0.32 | Good |
| 34 | 0.31 | 32 | A | A | 0.33 | Good |
| 35 | 0.56 | 57 | A | A | 0.32 | Good |
| 36 | 0.49 | 50 | A | A | 0.30 | Good |
| 37 | 0.40 | 41 | A | A | 0.24 | Good |
| 38 | 0.50 | 51 | A | B | 0.23 | Good |
| 39 | 0.50 | 51 | A | A | 0.21 | Good |
| 40 | 0.46 | 47 | A | A | 0.30 | Good |
| 41 | 0.45 | 46 | B | A | 0.26 | Good |
| 42 | 0.47 | 48 | A | A | 0.28 | Good |
| 43 | 0.46 | 47 | A | A | 0.35 | Good |
| 44 | 0.44 | 45 | A | B | 0.28 | Good |
| 45 | 0.47 | 48 | B | A | 0.30 | Good |
| Comparative Example 7 | 0.52 | 53 | A | C | 3.21 | Blurring, Scratches |
| 8 | 0.38 | 39 | C | B | 6.89 | Blurring, Scratches |
| 9 | 0.38 | 36 | B | A | 1.35 | Slight nonuniformity, Scrapes, Blurring |

The Evaluation Results of Examples 20 to 45 and Comparative Examples 7 to 9

From these results, when the resin of the present invention is used as the surface protective layer, no remarkable sensitivity degradation as the electrophotographic photosensitive member is observed, and the durability strength in the electrophotographic process can be remarkably improved. Furthermore, the adhesiveness to the lower layer, namely, the charge transport layer can be sufficiently maintained. Additionally, it has been found that when a coating material for the surface protective layer is prepared by using the resin of the present invention, the stability of the coating material is sufficiently high so that no trouble is caused even in the continuous production.

According to the present invention, using the uppermost surface layer of the present invention has made it possible to provide an electrophotographic photosensitive member comprising an uppermost surface layer excellent in adhesiveness and abrasion resistance, having hardness and toughness sufficient to prevent generation of scratches and the like, and not degrading the charge transport characteristics intrinsic to the photosensitive member. Furthermore, the uppermost surface layer of the present invention can be formed by coating in high productivity, which makes it possible to mass-produce the electrophotographic photosensitive member that is highly durable, highly stable and high in image quality. Additionally, according to the present invention, it has been made possible to provide the process cartridge and the electrophotographic apparatus that are constructed with the electrophotographic photosensitive member having the above described characteristics.

What is claimed is:

1. An electrophotographic photosensitive member comprising a photosensitive layer on a conductive support, wherein a surface layer of said photosensitive member contains a crosslinked epoxy-modified resol type phenolic resin obtained by adding a compound having at least two epoxy groups to a phenolic hydroxy group of a phenol-aldehyde resol type phenolic resin so that the phenolic groups and the epoxy groups undergo an addition and condensation reaction, and at least one of a charge transport material and a conductive fine particle.

2. The electrophotographic photosensitive member according to claim 1, wherein said epoxy modified resol type phenolic resin is free from any heteroatoms other than oxygen.

3. An electrophotographic photosensitive member according to claim 1, wherein said epoxy modified resol type phenolic resin is obtained by adding said compound having at least two epoxy groups, wherein said compound has a cyclic epoxy group represented by the following structural formula (1) or (2) in a molecule to said phenolic hydroxy groups of said resol type phenolic resin (1)

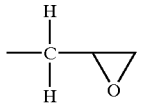

(2)

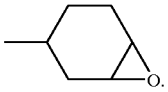

4. The electrophotographic photosensitive member according to claim 1, wherein said charge transport material has a hydroxy group.

5. A process cartridge comprising an electrophotographic photosensitive member according to claim 1 and at least one means selected from the group consisting of a charging means, a developing means and a cleaning means which are integrally supported, and being detachably mountable to the main body of an electrophotographic apparatus.

6. An electrophotographic apparatus comprising an electrophotographic photosensitive member according to claim 1, a charging means, an exposing means for forming an electrostatic latent image on said electrophotographic photosensitive member, a developing means for developing said electrostatic latent image into a toner image, and a transfer means for transferring said toner image onto a transfer medium.

* * * * *